US009655446B2

(12) United States Patent
Brady et al.

(10) Patent No.: US 9,655,446 B2
(45) Date of Patent: May 23, 2017

(54) DISPLAY TRAY

(71) Applicant: Innovative Packaging Designs L. P., Montgomeryville, PA (US)

(72) Inventors: Thomas R. Brady, Bethlehem, PA (US); Carl Jeffrey Jolley, Plymouth Meeting, PA (US)

(73) Assignee: INNOVATIVE PACKAGING DESIGNS L.P., Montgomeryville, PA (US)

( * ) Notice: Subject to any disclaimer, the term of this patent is extended or adjusted under 35 U.S.C. 154(b) by 0 days.

(21) Appl. No.: 14/491,179

(22) Filed: Sep. 19, 2014

(65) Prior Publication Data

US 2015/0076096 A1 Mar. 19, 2015

Related U.S. Application Data

(60) Provisional application No. 61/879,939, filed on Sep. 19, 2013.

(51) Int. Cl.

| | |
|---|---|
| ***A47G 29/00*** | (2006.01) |
| ***A47F 3/14*** | (2006.01) |
| ***A47J 47/00*** | (2006.01) |
| ***A47B 87/02*** | (2006.01) |
| ***A47F 5/11*** | (2006.01) |
| ***A47B 55/06*** | (2006.01) |
| ***A47B 43/02*** | (2006.01) |

(52) U.S. Cl.

CPC ..... *A47B 87/0253* (2013.01); *A47B 43/02* (2013.01); *A47B 55/06* (2013.01); *A47B 87/0269* (2013.01); *A47F 5/112* (2013.01); *A47F 5/114* (2013.01)

(58) Field of Classification Search

CPC . A47B 87/0253; A47B 87/0269; A47B 43/00; A47B 47/06; A47B 55/06; A47B 43/02; A47F 5/12; A47F 5/10; A47F 5/108; A47F 5/112; A47F 5/114; A47F 5/116; A47F 3/14; A47F 5/11; B65D 5/0015; B65D 5/002; B65D 5/22; B65D 5/001

USPC ..... 211/132.1, 72, 73, 133.6, 126.16, 135, 211/70.1; 248/152, 154, 174, 300; 206/736, 750, 45.21, 45.25, 525.1, 769, 206/772, 774, 509, 512; 229/162.1, 229/162.3, 162.6, 164, 178, 186, 915, 229/918, 919, 109, 191, 199, 120.01, 229/120.02, 120.24, 120.25, 120.26, 229/120.38, 185.1, 190

See application file for complete search history.

(56) References Cited

U.S. PATENT DOCUMENTS 3,036,753 A * 5/1962 Davis ..... B65D 5/08 206/509

3,055,573 A * 9/1962 Carter ..... B65D 5/002 229/117.16

(Continued)

*Primary Examiner* — Jennifer E Novosad

(74) *Attorney, Agent, or Firm* — Fox Rothschild LLP

(57) ABSTRACT

A display tray with multiple side panels attached to one another to form tray sides. The display tray includes a tray surface having an area defined by the first, second, third, and fourth four side panels. Additionally, the display tray includes multiple corner columns, with a corner column located in each corner of the tray. Each corner column upwardly extends from the tray surface and is sturdy enough to support the stacking of another design tray on top.

17 Claims, 9 Drawing Sheets

(56) References Cited

U.S. PATENT DOCUMENTS 4,753,341 A * 6/1988 McIntyre ..... B65D 5/48018 211/130.1
5,520,325 A * 5/1996 Quaintance ..... B65D 5/48026 229/120.26
5,992,735 A * 11/1999 Oosterbaan ..... B65D 5/002 229/191
6,454,107 B1 * 9/2002 Belanger ..... B65D 5/724 206/556
6,513,705 B1 * 2/2003 Sheffer ..... B65D 5/0025 206/509
6,520,898 B1 * 2/2003 Moen ..... B65D 5/322 493/128
6,712,214 B1 * 3/2004 Wintermute ..... B65D 5/003 206/509
7,252,200 B1 * 8/2007 Hester ..... A47F 5/116 211/126.16
7,635,080 B2 * 12/2009 Conway ..... B65D 5/0025 229/169
7,637,372 B2 * 12/2009 Keel ..... B65D 5/0025 206/509
7,861,916 B2 * 1/2011 Little ..... B31B 1/25 229/120.24
7,981,017 B2 * 7/2011 Little ..... B31B 1/14 206/509
8,205,787 B2 * 6/2012 Panduro, Jr. ..... B65D 5/0015 229/143
9,022,276 B2 * 5/2015 Little ..... B65D 5/48014 229/120.17
2006/0038000 A1 * 2/2006 Sheffer ..... B65D 5/0035 229/164
2006/0231603 A1 * 10/2006 McLeod ..... B65D 5/4608 229/141
2007/0246398 A1 * 10/2007 Pedler ..... A47F 5/112 206/745
2008/0237160 A1 * 10/2008 Pedler ..... A47F 1/08 211/59.2
2009/0272756 A1 * 11/2009 Hackney ..... A47F 1/08 221/154
2010/0083618 A1 * 4/2010 Little ..... B31B 17/00 53/450
2013/0319963 A1 * 12/2013 Coon ..... A47F 5/116 211/149
2015/0076096 A1 * 3/2015 Brady ..... A47B 87/0253 211/132.1

* cited by examiner

DISPLAY TRAY

This application claims the benefit of U.S. Provisional Application No. 61/879,939, filed on Sep. 19, 2013, the contents of which are incorporated herein by reference.

FIELD OF THE INVENTION

The present invention relates to containers, and more particularly to containers that can be used as stackable display trays.

BACKGROUND OF THE INVENTION

Display trays are widely used in retail stores or the like to display packaged items such as food, candy, DVDs, CDs, vitamin supplements, consumer packaged goods toys, or the like for prospective customers to simply lift the goods from the tray to drop into their shopping basket. Prior art trays, such as the example depicted in FIG. 1, were generally formed as a roll over tray with a partition. These trays included columns to allow stacking of multiple trays in the retail store while displaying product within.

One type of prior art display tray 1000, illustrated in FIG. 1, is assembled by the user, e.g., a packer, from two separate sections—a bottom section 1002 and an upper section 1010. The bottom and upper sections 10002, 1010 are delivered to the user as separate sections which are stored prior to assembly. To assemble, the bottom section 1002 is partially assembled. Then, the upper section 1010 is assembled and placed onto the partially assembled bottom section 1002. Finally, the side flaps 1004 of the bottom section 1002 are rolled around side sections of the upper section 1010 to combine the two together, thereby forming the assembled container shown in FIG. 1.

There are numerous disadvantages associated with prior art display trays. They have multiple sections 1002, 1010 for each container to be shipped to and warehoused by the packer prior to final assembly. Additionally, the divider walls 1012, which are used to support another display tray on top, create inner areas 1014, 1016, 1018 divided from one another as seen in FIG. 1. This separates merchandise within, and makes it difficult for consumers to see goods sitting in areas behind a divider wall.

Thus, it believed that there is a need for an improved display tray that will be easier and less expensive to ship, store, and assemble, and which will provide full view to consumers of the products within while still providing the desired rigidity for the purposes of stacking multiple trays on top of each other. It is further believed that improvements in the amount of time to assemble the container can be made, while using less material in the container to lower costs and make less of an environmental impact.

SUMMARY OF THE INVENTION

The present invention provides an improved container display tray that is assembled from a single piece that can be folded to form the fully assembled display tray.

Broadly, the invention provides a knockdown that can be assembled into a display tray having first, second, third and fourth side panels and four corner columns. The knockdown is formed from a lower blank and an upper blank. The lower blank includes a lower central region having first, second, third, and fourth edges. The lower central region is surrounded at each edge by first, second, third and fourth sidewall segments. At least two of the sidewall segments include a rollover portion. Additionally, the second and fourth sidewall segments extend from a respective first end to a respective second end, and end flaps are attached to each first end and each second end of both the second and fourth sidewall segments.

The upper blank includes an upper central region having first, second, third, and fourth edges. The upper blank further includes a first sidewall segment attached at the second edge, a second sidewall segment attached at the fourth edge, and first, second, third, and fourth column portions extending from first, second, third, and fourth corners of the upper central region. The upper central region and the lower central region having substantially the same shape and size.

The knockdown is formed when a lower surface of the upper blank is adhesively attached to an upper surface of the lower blank so as to line up the upper central region on top of the lower central region. In certain embodiments, V notches located on the upper and lower blanks may be used to optically line up the upper and lower blanks.

The invention also provides for a display tray with multiple side panels attached to one another to form tray sides. The side panels include a first, second, third and fourth side panel. The first and second side panels are attached to one another at a first corner; the second and third side panels attached to one another at a second corner; the third and fourth side panels attached to one another at a third corner; and the fourth and first side panels are attached to one another at a forth corner. The display tray also includes a tray surface having an area defined by the first, second, third, and fourth four side panels. Additionally, the display tray includes multiple corner columns, with a corner column located in each corner of the tray. Each corner column upwardly extends from the tray surface and is sturdy enough to support the stacking of another design tray on top.

BRIEF DESCRIPTION OF THE FIGURES

The foregoing summary and the following detailed description may be better understood when read in conjunction with the accompanying drawings. For the purpose of illustrating the invention, one preferred embodiment is shown in the drawings. It is understood, however, that this invention is not limited to the precise arrangements shown.

DETAILED DESCRIPTION

The invention disclosed herein is a novel container useable as a display tray. Described below is a preferred embodiment; it being recognized, however, that the present invention can be adapted to containers and displays having other configurations and features used for other purposes.

Figure 1:
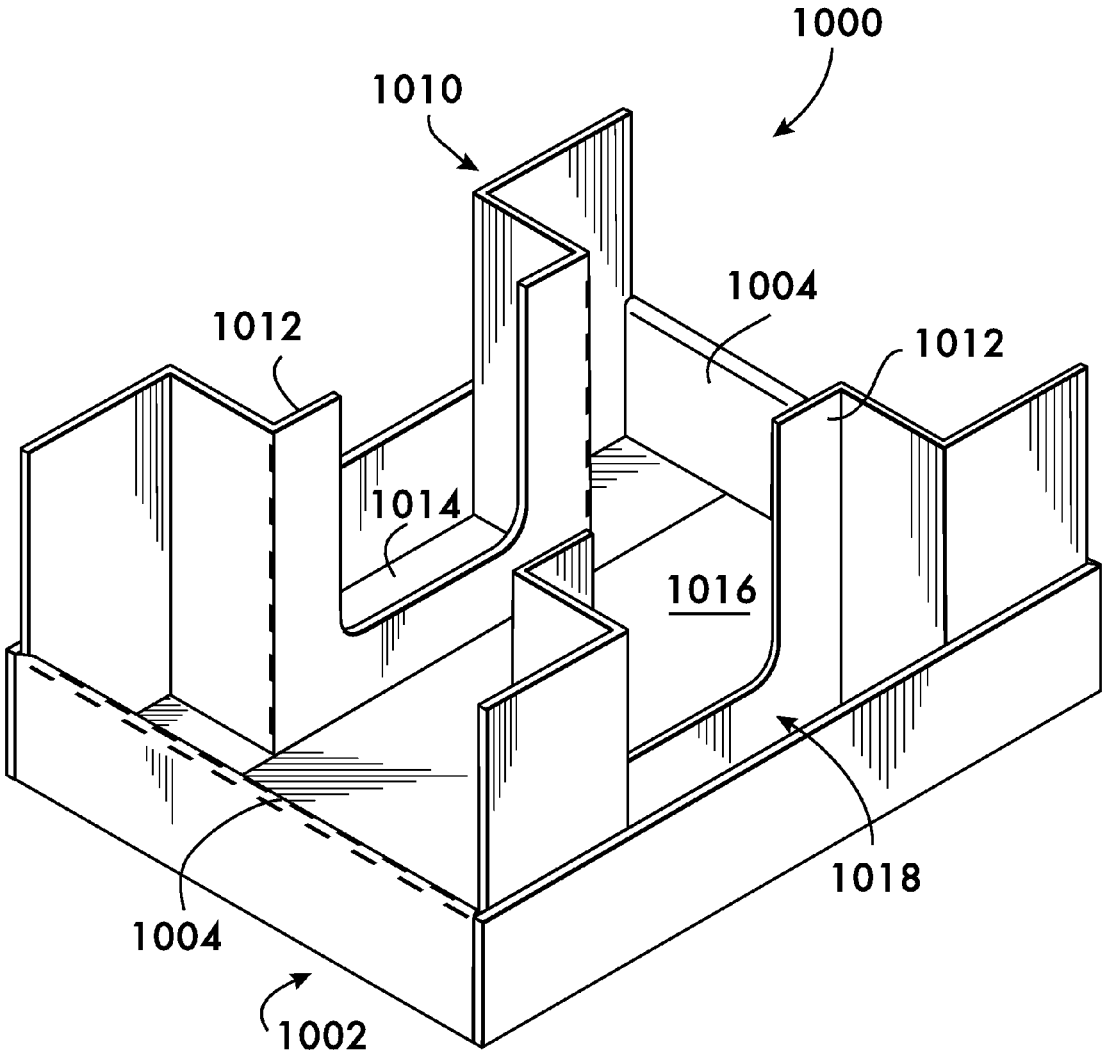
FIG. 1 PRIOR ART
FIG. 1 is a perspective view of a prior art display tray.
Figure 2:
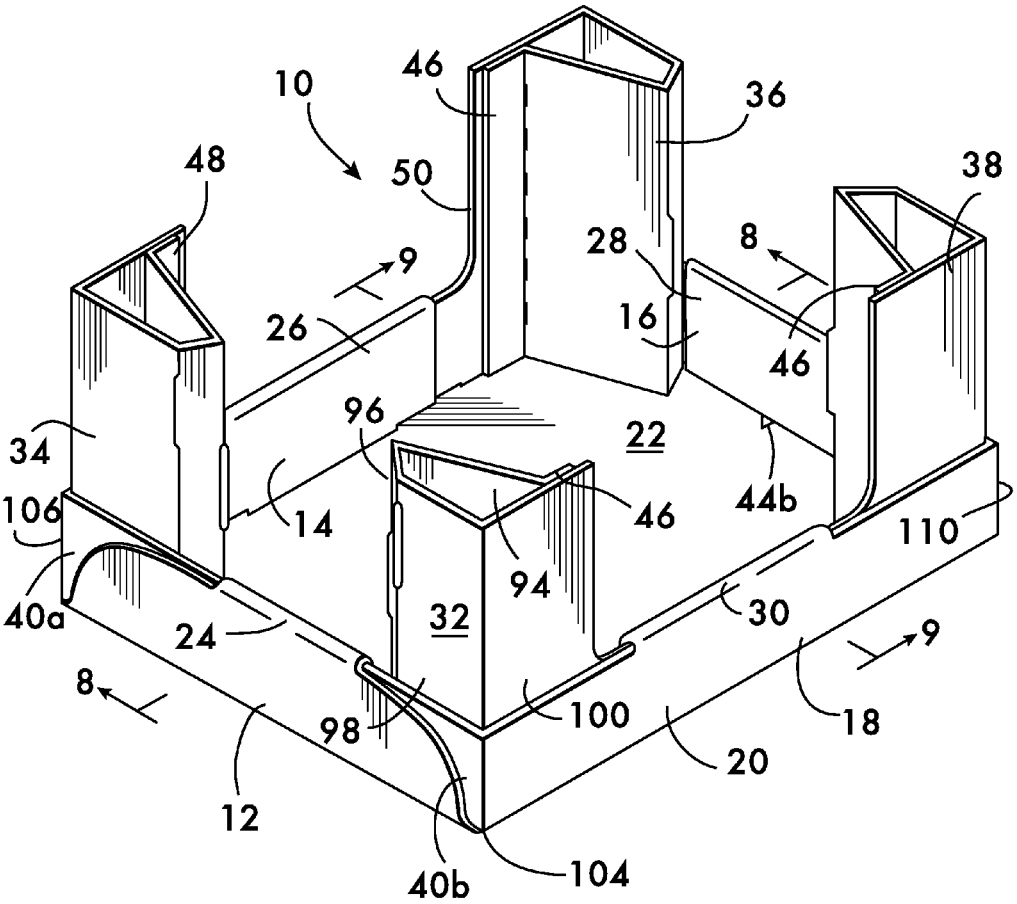
FIG. 2 is a perspective view of an exemplary display tray in accordance with an embodiment of the invention.

Reference now will be made in detail to an exemplary embodiment of the invention as illustrated in FIG. 2 showing a display tray 10 for displaying goods. The display tray 10 has multiple side panels attached to one another to form the tray sides. In this particular example, the multiple side panels include a first side panel 12, a second side panel 14, a third side panel 16, and a fourth side panel 18. The side panels are attached to one another at common corners: the first side panel 12 and the fourth side panel 18 are attached at a first folded corner 104; the first side panel 12 and the second side panel 14 are attached at a second folded corner 106; the second side panel 14 and the third side panel 16 are attached at a third folded corner 108 (not shown in FIG. 2); and, the third side panel 16 and the fourth side panel 18 are attached at a fourth folded corner 110. As explained in more detail below, the first side panel 12 is formed by folding a first rollover 24 over end flaps 40*a*, 40*b*. Similarly, the opposing third side panel 16 is formed from folding a third rollover 28 over end flaps 42*a*, 42*b*. The second and fourth side panels 14, 18 are formed as described below.

Figure 10:
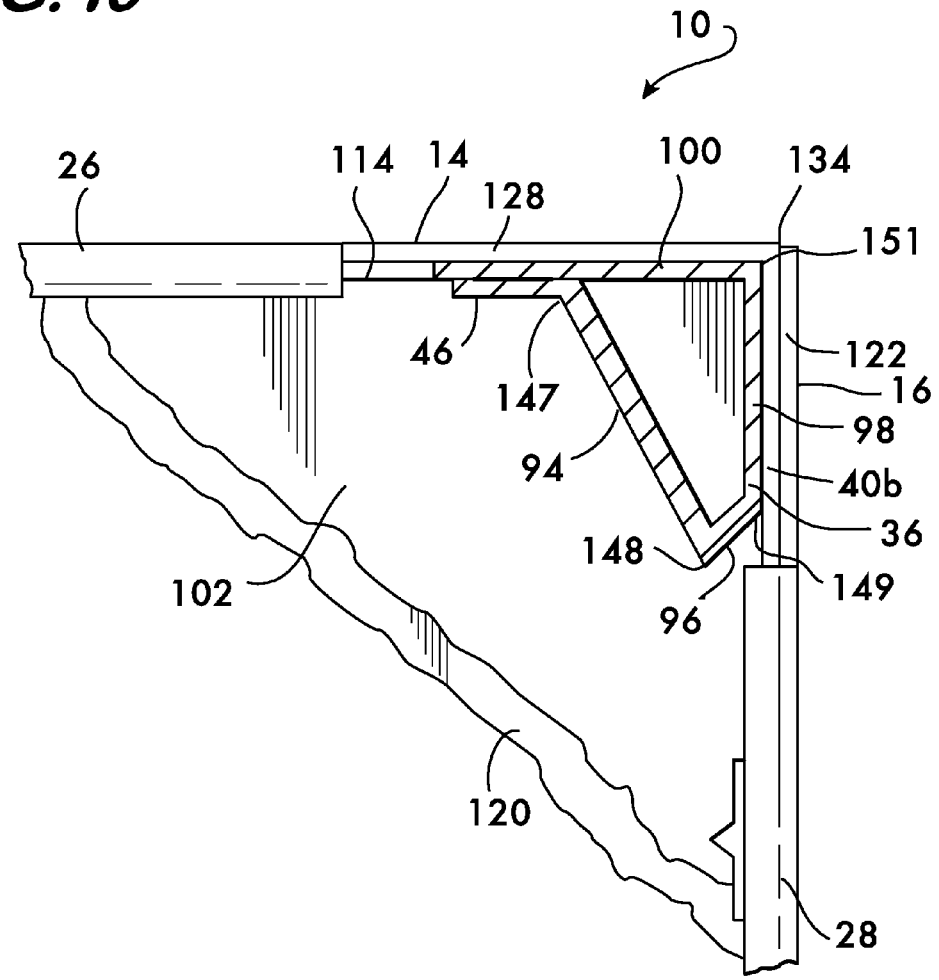
FIG. 10 is a cross-sectional view taken along line 10-10 of FIG. 8.

The display tray also includes at each corner first, second, third and fourth corner columns 32, 34, 36, 38. The corner columns are sufficiently sturdy to support the stacking of multiple display trays 10 on top of each other. As shown in FIG. 2 with respect to the first corner column 32, each corner column includes preferably first, second, third, and fourth column walls 94, 96, 98, 100. While the illustrated embodiment, as shown in FIG. 10, employs corner columns having a trapezium shaped cross-section, it is understood that the corner columns may be shaped in other configurations. As discussed in more detail below, depicted in FIGS. 2 and 10, the corner columns are formed by adhesively connecting an attachment portion 46, integrally attached at one end of the column portion, to the column wall 100.

Figure 3:
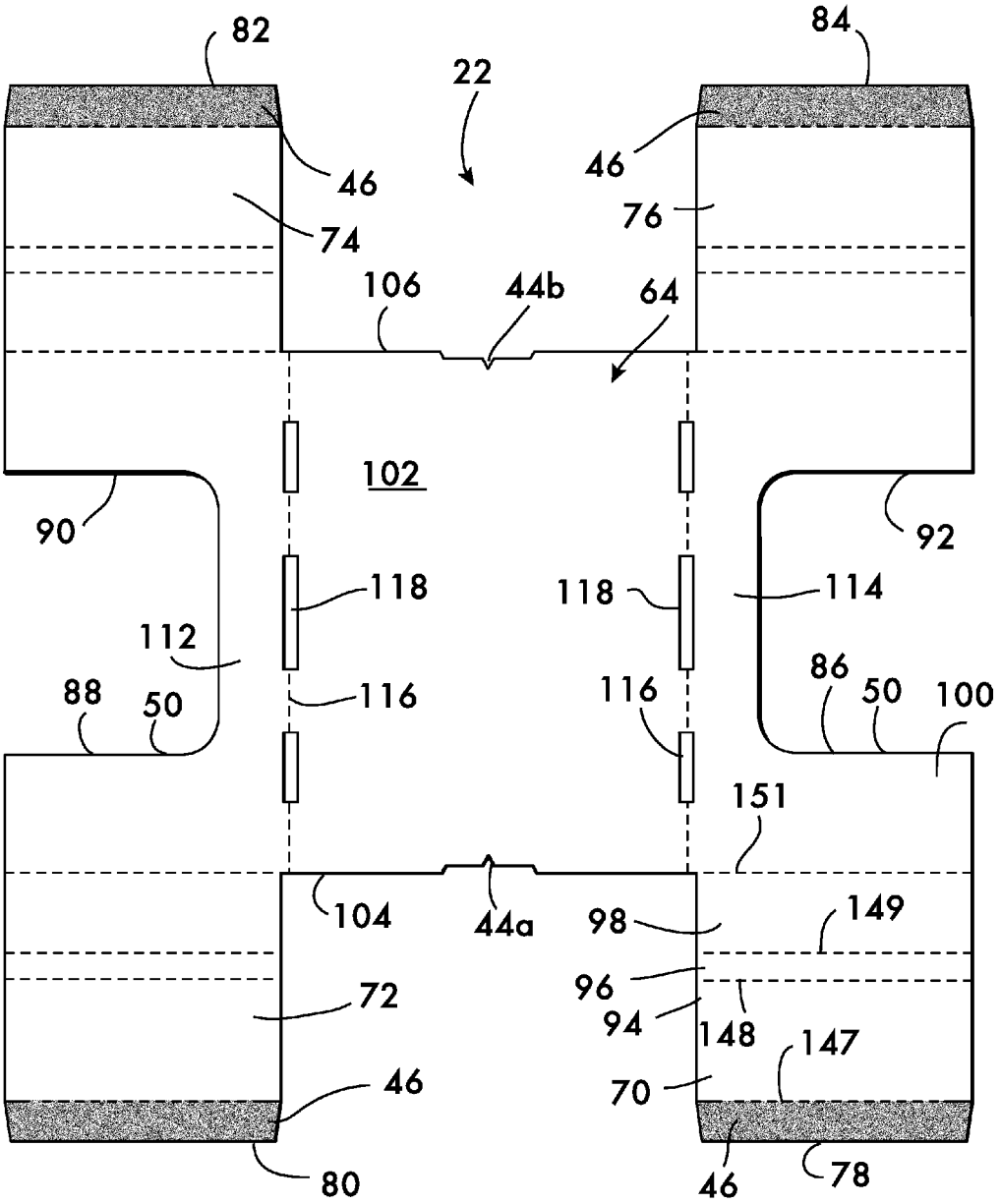
FIG. 3 is a plan view of a top blank for making the display tray of FIG. 2.
Figure 4:
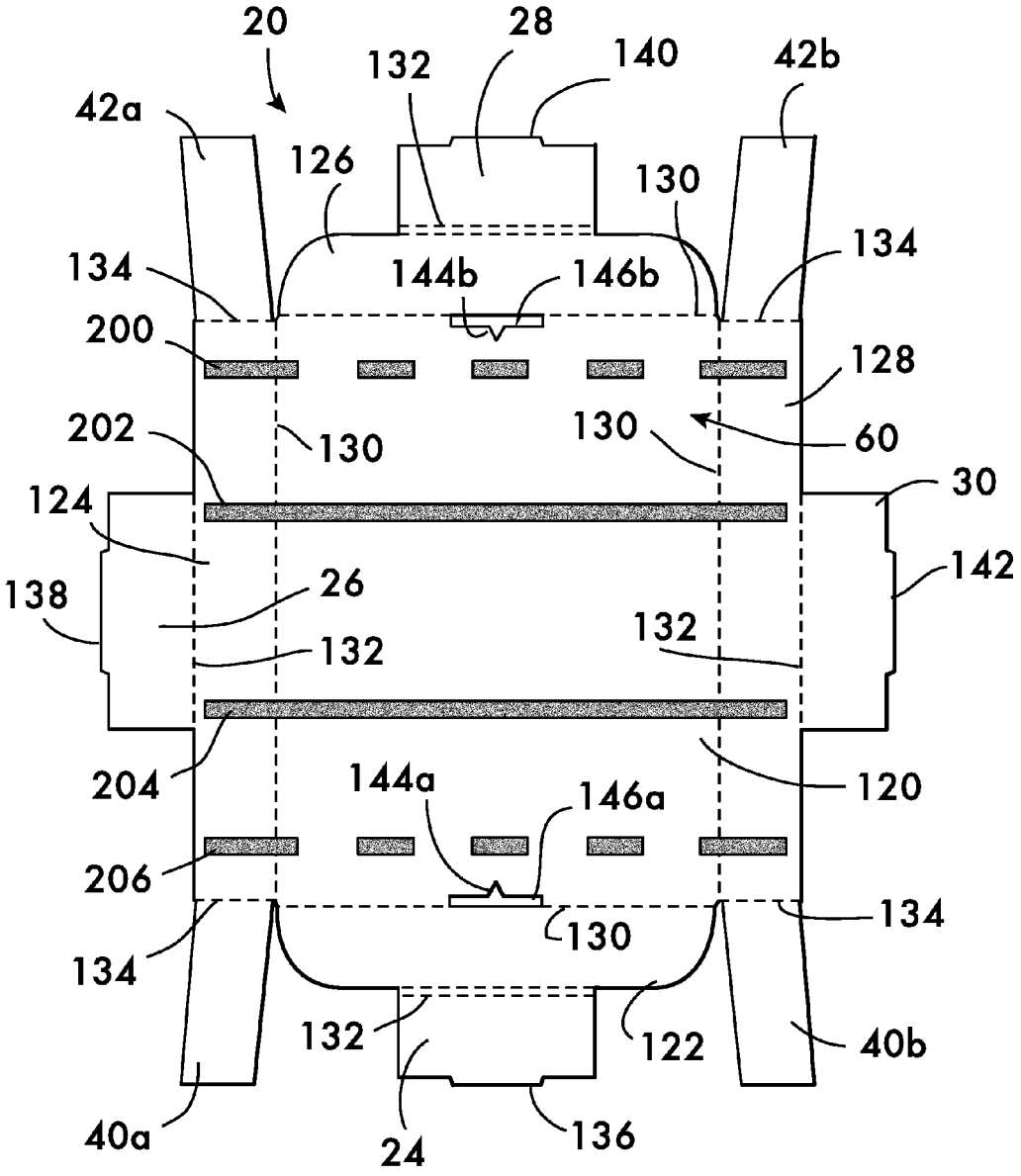
FIG. 4 is a plan view of a bottom blank for making the display tray of FIG. 2.

With further reference to FIGS. 3 and 4, an upper blank 22 and a lower blank 20 for making the display tray 10 are now described. As will be described below, the blanks 20, 22 are assembled to form the knockdown 300 shown in FIG. 6A, which knockdown 300 can be folded into the erected display tray 10. The blanks 20, 22 are preferably die cut from a unitary sheet of corrugated paperboard, the illustrated embodiment using mottled white corrugated sheet having an outer face with a paper finish that is ideal for printing, and an unfinished kraft inner face. The blank 20 in FIG. 4 is oriented to show the inner face 60 of the blank 20. The upper blank 22 in FIG. 3 is oriented to show the inner face 64 of the blank 22.

Referring to FIG. 3, the upper blank 22 includes as an integral unit a central portion 102, as well as first, second, third and fourth column portions 70, 72, 74, 76 extending from the corners of the central portion 102. The central portion 102 extends from a first end 104 to a second end 106. Two V notches 44*a*, 44*b* are located on the first and second ends 104, 106 of the upper blank 22 for alignment purposes as discussed below. The central portion 102 also includes first and second side segments 112, 114 located on opposing sides of the upper blank 22. The side segments 112, 114 are separated from the remainder of the central portion 102 by score lines 116. When folded along the score lines 116, the side segments 112, 114 make up a portion of the second and fourth side panels 14, 18 of the fully formed display tray 10 depicted in FIG. 2, with the score lines 116 forming the bottom edges of the second and fourth side panels 14, 18. Preferably, as shown in FIG. 3, slots 118 are provided along each of the score lines 116. The slots 118 provide relief when the two corner edges of the upper blank 22 and the lower blank 20 are folded on top one another and may be further configured to receive a tab as described hereinafter. In this embodiment, the blank includes display opening cutouts 50.

Each column portion 70, 72, 74, 76 extends from a respective lateral end 78, 80, 82, 84 to a respective medial end 86, 88, 90, 92. The column attachment portions 46 are located at the lateral end 78, 80, 82, 84 of the respective column portions 70, 72, 74, 76. The column portions each also include first, second, third, and fourth column walls, identified on the first column portion 70 as column walls 94, 96, 98, 100. It is understood that the second, third and fourth column portions 72, 74, 76 include identical column walls. The column walls are separated by fold lines 148, 149, 151 that allow for easy folding of the column section in constructing a respective corner column of the tray. An additional score line 147 separates the attachment portion 46 from the column wall 94.

The fold and score lines can be formed by scores and perforations, or in any other known way. In the illustrated embodiment, the fold lines are provided by scores and knife cuts as follows: fold line 147 (here running across the entire corner column) is formed as a series of a ½ inch length knife cut followed by a ¼ inch length crease across the flap; fold line 148 is formed as a 2 inch length cut in the center of the fold line with a 6 point score extending from the cut on both sides to the end of the flap; fold line 149 is formed of 2 knife cuts 1½ inch in length separated and having an 8 point score extending between the two cuts and from the cuts to the ends of the flap; fold line 151 is formed from a 4 point score; and fold line 116 is formed from an 8 point score with three cutouts as shown. Fold line 149 is formed as indicated above to make this fold line weaker than the other fold lines on the corner column so that during the folding process to make the knockdown described below, the column is more prone to fold at fold line 149 than the other fold lines, which is preferred for automated machinery. The fold and score lines may be formed in any other desired manner.

Referring to FIG. 4, the lower blank 20 includes a generally rectangular central portion 120, which is surrounded on all sides by first, second, third and fourth sidewall segments 122, 124, 126, 128. The sidewall segments are separated from the central portion 120 by score lines 130. When folded along the score lines 130, the first, second, third and fourth sidewall segments 122, 124, 126, 128 form portions of the first, second, third and fourth side panels 12, 14, 16, 18 of the fully constructed display tray 10. Attached to each sidewall segment 122, 124, 126, 128 is a respective first, second, third, and fourth rollover portion 24, 26, 28, 30. Preferably, one or more score lines 132 separate each rollover portion from the respective sidewall segment to allow for easier folding. The rollover portions each include a respective locking tab 136, 138, 140, 142.

A set of first end flaps 40*a*, 40*b* and a set of second end flaps 42*a*, 42*b* are attached at each end of the second and fourth sidewall segments 124, 128. The end flaps are separated from the sidewall segments by score lines 134. When folded into place, the end flaps form a portion of the first and third side panels 12, 16. As shown in FIG. 4, the end flaps are angled outward from the remainder of the bottom blank 20 to allow slight bending past 0 degrees when assembling the tray 10, the edge of the flaps being angled preferably about 6 degrees plus or minus 1 degree relative to the score line 130, and more preferably about 5.8 degrees. This slight bending allows for straighter corner columns.

The central portion 120 further includes V notches 144*a*, 144*b* that line up with the V notches 44*a*, 44*b* on the central portion 102 of the upper blank 22 during assembly. Adjacent the V notches 144*a*, 144*b* are rectangular locking apertures 146*a*, 146*b*, which are sized to receive the locking tabs 136, 140 of the first and third rollover portions 24, 28. The various fold lines for the lower blank section can be made of any suitable type, such as 6 point scores.

Figure 5:
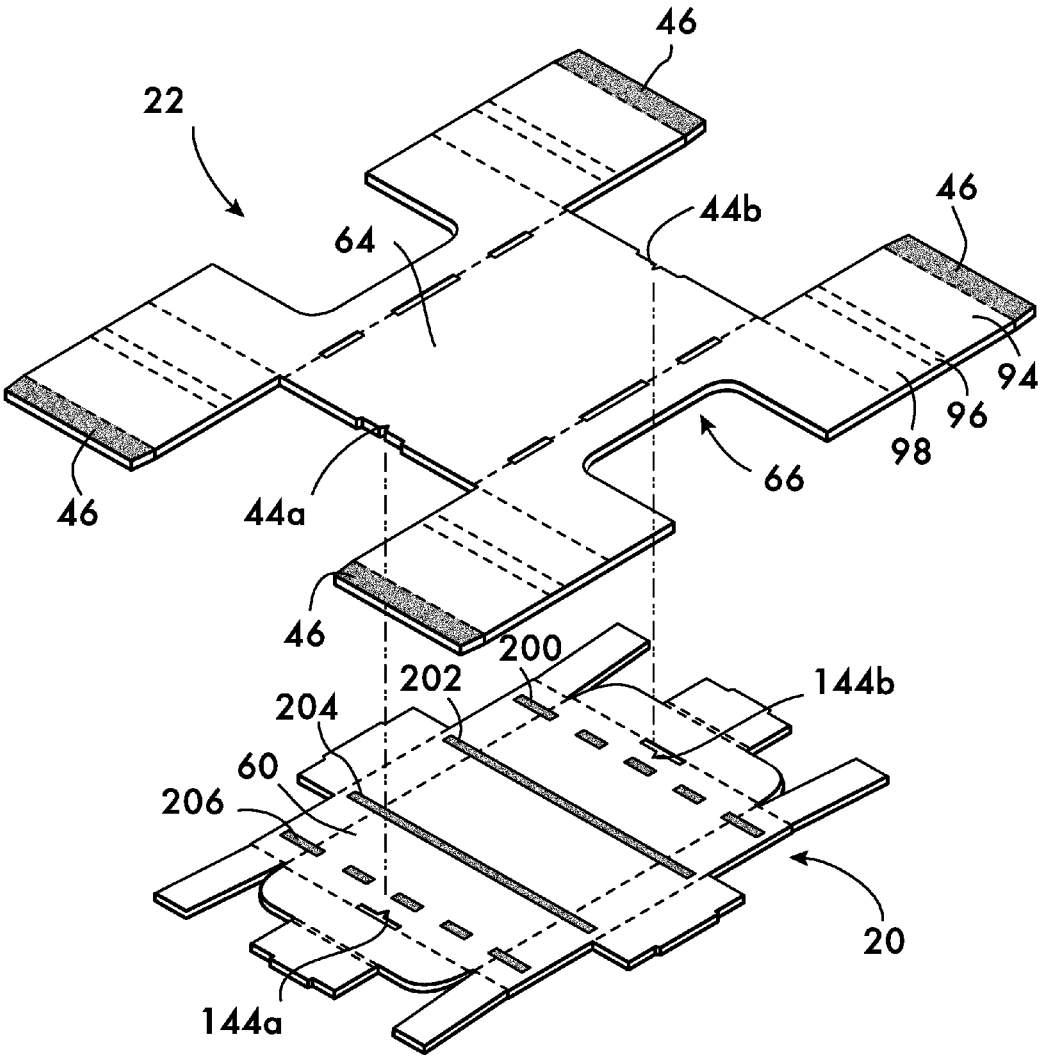
FIG. 5 is a perspective view of the blanks shown in FIGS. 3 and 4 illustrating a step of assembly of a knockdown of the display tray.
Figure 6:
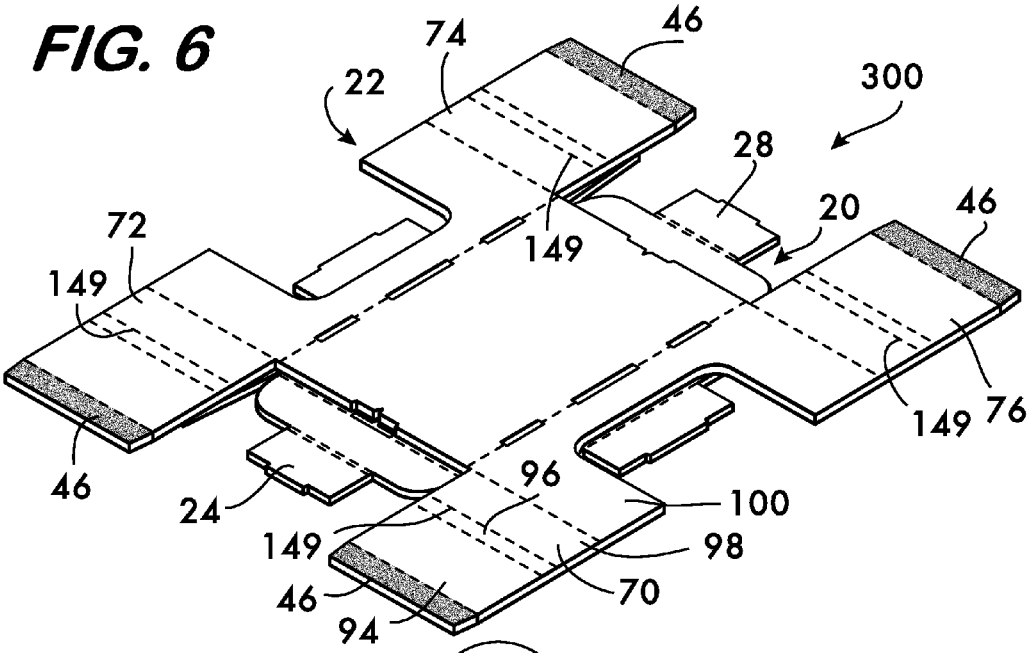
FIG. 6 is a perspective view of the top side of the blanks shown in FIGS. 3 and 4 in a step of the assembly of a knockdown of the display tray of FIG. 2.
Figure 7:
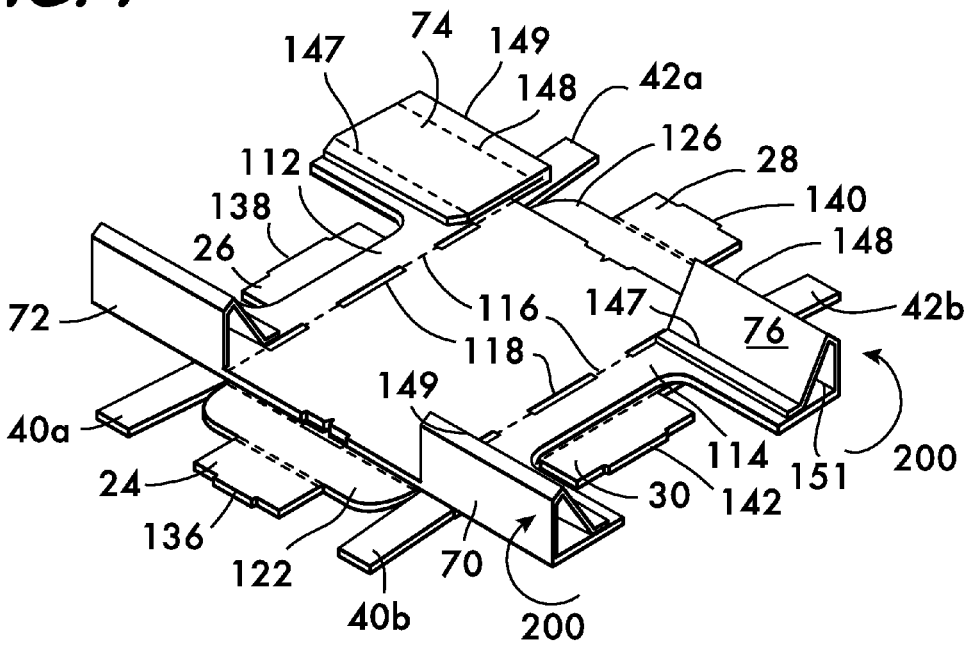
FIG. 7 is a perspective top view of the knockdown shown in FIG. 6A illustrating an initial step in assembling the knockdown into the fully erected display tray of FIG. 2.

FIGS. 5-7 depict steps in assembling the blanks 20, 22 into a knockdown 300 that can be folded into the display tray 10. To form the knockdown 300, adhesive, such as glue, is provided as shown in FIG. 4 in the form of strips 200, 202, 204, 206 on the inner face 60 of the lower blank 20. Application of the glue by an automated machine is preferred. It is preferable that cold set glue be used to provide sufficient time—about thirty to forty seconds—for adjustments as needed when attaching the lower blank 20 to the upper blank 22. The glue pattern provided may be in the illustrated configuration with two glue strips 200, 206 that are broken lines and the other two glue strips 202, 204 that are solid lines. The glue strips 200, 202, 204 206 span the central portion 120 of the lower blank 20, and extends to the opposing sidewall segments 124, 128.

Next, the die cut upper blank 22, as shown in FIG. 5, is dropped onto lower blank 20 with the outer face 66 of the upper blank 22 contacting the inner face 60 of the lower blank 20 and the glue thereon. The two blank sections can be aligned properly by lining up the V notches 44*a*, 44*b* of the upper blank with the corresponding V notches 144*a*, 144*b* of the lower blank. Preferably, in an automated fabrication process, a camera sensor is used to make sure that upper and lower blanks 20, 22 are lined up within + or −1 mm in view of the tolerances needed for the folding of the knockdown 300 to form the tray 10. Preferably, the lower and upper blanks are cut so as to provide an eighth of an inch between the top edge of either the end flaps or the first and second side segments 112, 114 of the upper blank 22 and the location of the fold of the respective rollover for clearance and movement when folding the rollovers into place.

Figure 6A:
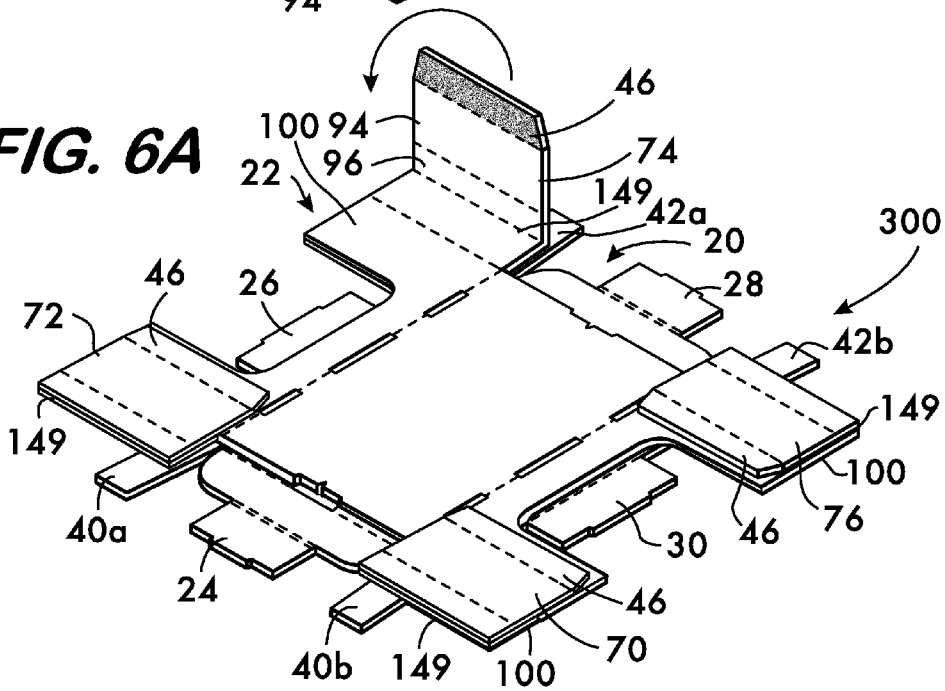
FIG. 6A is a perspective top view of the assembly shown in FIG. 6 just prior to final knockdown form, illustrating the folding of the panels to create the final knockdown form.

Adhesive, such as a cold set glue, is placed on the attachment portions 46 of the respective column portions 70, 72, 74, 76. With the glue applied, as shown in FIGS. 6 and 6A, the attachment and wall portions 46, 94 and 96, for each column wall are folded as a unit about the score lines 149 moving the attachment portion 46 into contact with the fourth column wall 100 near the medial end of the column portion, thereby adhesively connecting these two portions together and forming the un-erected flat corner columns as shown. Preferably, in an automated assembly, a picker and arm bar performs this step of the assembly. Once all four corner columns are formed by the above process, the knockdown 300 is completed, allowing a stack of multiple such knockdowns to be shipped to and stored by the user, such as a packer.

Figure 7A:
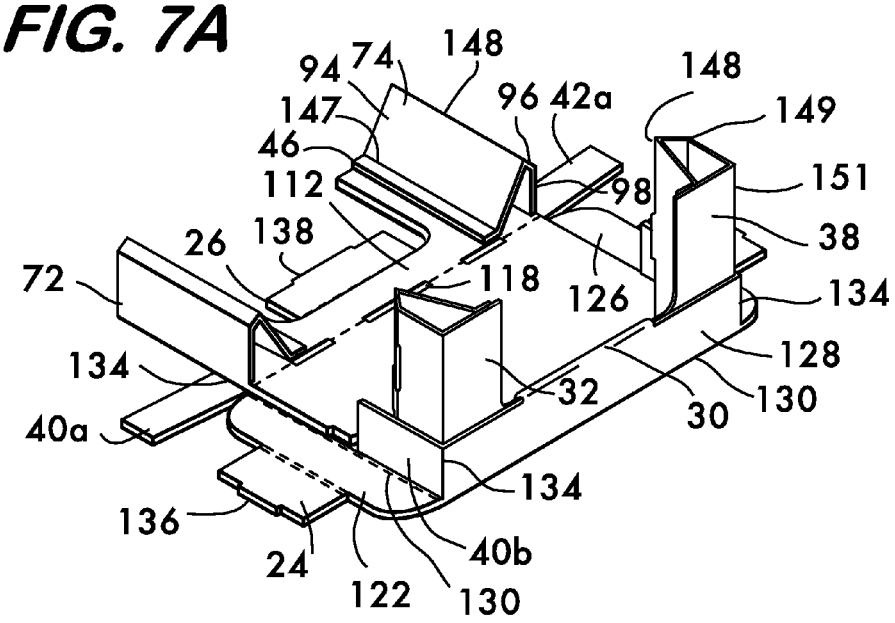
FIG. 7A is a perspective top view of the container shown in FIG. 7 illustrating another step in assembling the knockdown into the fully erected display tray of FIG. 2.
Figure 8:
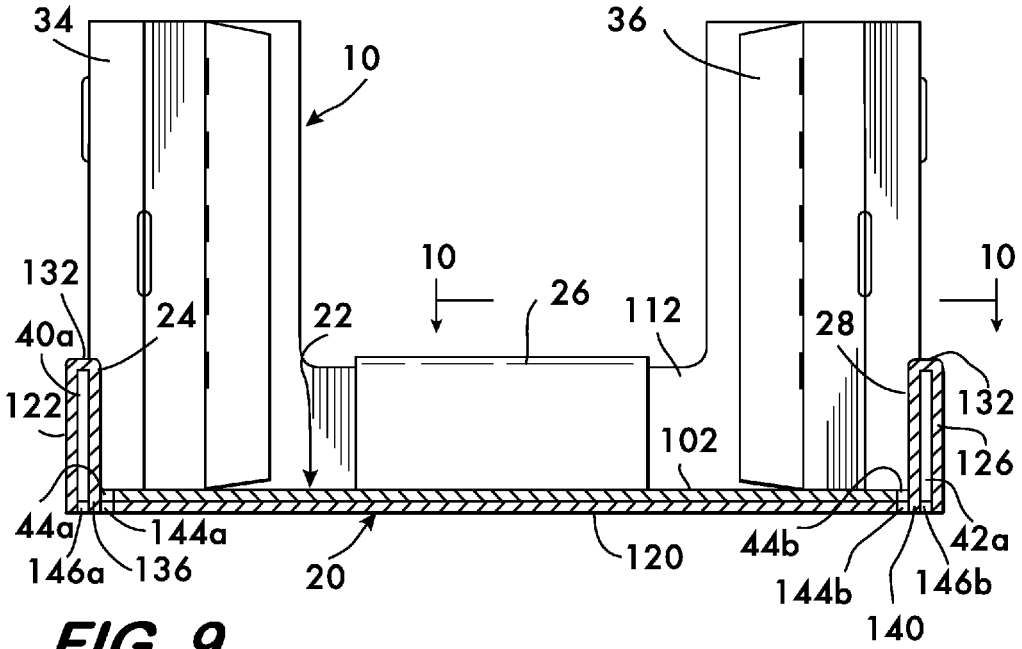
FIG. 8 is a cross-sectional view taken along line 8-8 in FIG. 2.
Figure 9:
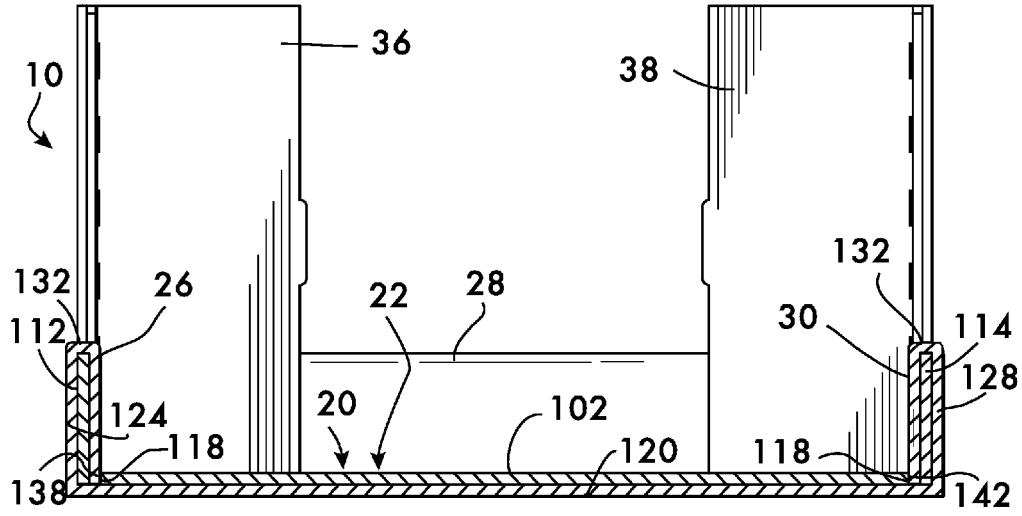
FIG. 9 is a cross-sectional view taken along line 9-9 in FIG. 2.

Assembly of the knockdown 300 into the tray 10 will be described with reference to FIGS. 2 and 7-10. Referring to FIGS. 7, 7A and 10, first the corner columns are folded as indicated by arrows 200 in FIG. 7 with the column walls 94, 96, 98 folding about the lines 147, 148, 149, 151 (see FIG. 10). Next, with particular reference to FIG. 7A, the second and fourth side segments 124, 128 of the lower blank 20 and the first and second side segments 112, 114 of the upper blank 22 are folded as an adhered unit along the score lines 116, 130 of the lower and upper blanks, respectively. The second and fourth rollovers 26, 30 may then be folded over the first and second side segments 112, 114 of the upper blank 22 and the tabs 138, 142 received in respective slots 118 as shown in FIG. 9. This step can either be done by hand or by use of a fixture into which the combined blank is pushed by the user to fold the two sides. This fixture may be made of wood, plastic or metal.

Next, the end flaps 40*a*, 40*b*, 42*a*, 42*b* are folded along score line 134. Once in place, the first and third side segments 122, 126 of the lower blank 20 are folded along the score line 130 and the first and third rollovers 24, 28 are folded along the score lines 132 over the end flaps as illustrated in FIG. 8. The rollovers 24, 28 are set in place by placing the tabs 136, 140 in the locking apertures 146*a*, 146*b*. With the rollovers 24, 28 set in place, the tray 10 is maintained in its final assembled state as illustrated in FIG. 10. It should be noted that the rollovers 26, 30 are not needed to create the fully assembled display tray 10, but instead are used to give the display tray 10 a nicer appearance because they cover a cut edge of the upper blank 22.

While particular embodiments of the invention are described herein, it is not intended to limit the invention to such disclosure. Changes and modifications may be incorporated and embodied within the scope of the appended claims.

We claim:

1. A knockdown assembly configured to be assembled into a display tray having first, second, third and fourth side panels and four corner columns, the knockdown assembly comprising:

a lower blank comprising a lower blank central region having first, second, third, and fourth edges and surrounded at each edge by first, second, third and fourth sidewall segments, at least the first and third sidewall segments including a rollover portion, wherein each of said second and fourth sidewall segments extend from a respective first end to a respective second end, and wherein end flaps are attached to each first end and each second end of both the second and fourth sidewall segments;

an upper blank comprising an upper blank central region having first, second, third, and fourth edges, a first sidewall segment attached at the second edge, a second sidewall segment attached at the fourth edge, and first, second, third, and fourth column portions extending from first, second, third, and fourth corners of the upper blank central region, said upper blank central region and said lower blank central region having substantially the same shape and size;

wherein a lower surface of the upper blank is adhesively attached to an upper surface of the lower blank so as to line up the upper central region on top of the lower central region; and wherein each column portion includes a plurality of fold lines dividing each of said column portions into at least three column walls, and wherein said column walls are foldable relative to one another about said fold lines such that each of said corner columns have a polygonal cross-section when said knockdown is assembled into said display tray.

2. The knockdown assembly according to claim 1 wherein the lower blank is substantially planar and the upper blank is substantially planar.

3. The knockdown assembly according to claim 1 wherein each of the upper and lower blanks is formed from a single, unitary sheet of corrugated paperboard.

4. The knockdown assembly according to claim 1 wherein each column portion includes a median edge integral with the upper blank central region and a lateral edge, wherein each column portion is folded upon itself, and wherein the lateral edge is secured proximate to the median edge.

5. The knockdown assembly according to claim 1 wherein each column portion includes four column walls such that each of said column portions define a trapezium shaped cross-section when the knockdown is assembled into said display tray.

6. The knockdown assembly according to claim 1 wherein each corner column is configured to extend substantially perpendicular to the upper central region when said knockdown assembly is assembled into the display tray.

7. The knockdown assembly according to claim 6 wherein for each corner column, one of the column walls is configured to be parallel to one of the upper central region edges and a second of the column walls is configured to be parallel to a second one of the upper central region edges when said knockdown assembly is assembled into the display tray.

8. The knockdown assembly according to claim 7 wherein the column walls other than said one and said second of the column walls of each corner column are configured to be non-parallel with respect to the upper central region edges when said knockdown assembly is assembled into the display tray.

9. The knockdown assembly according to claim 1 wherein the first end flaps are configured to extend along the lower central region first edge with the first edge rollover portion folded over and retaining the first end flaps and the second end flaps are configured to extend along the lower central region third edge with the third edge rollover portion folded over and retaining the second end flaps when said knockdown assembly is assembled into the display tray.

10. The knockdown assembly according to claim 1 wherein the lower central region includes at least one lower V-notch and the upper central region includes at least one upper V-notch, and wherein the lower V-notch and upper V-notch is aligned upon attachment of the upper and lower blanks.

11. The knockdown assembly according to claim 1 wherein each upper blank sidewall segment defines a display opening cutout.

12. A display tray formed from the knockdown assembly according to claim 1.

13. A knockdown assembly configured to be assembled into a display tray having first, second, third and fourth side panels and four corner columns, the knockdown assembly comprising:

a lower blank comprising a lower blank central region having first, second, third, and fourth edges and surrounded at each edge by first, second, third and fourth sidewall segments, at least the first and third sidewall segments including a rollover portion, wherein each of said second and fourth sidewall segments extend from a respective first end to a respective second end, and wherein end flaps are attached to each first end and each second end of both the second and fourth sidewall segments;

an upper blank comprising an upper blank central region having first, second, third, and fourth edges, a first sidewall segment attached at the second edge, a second sidewall segment attached at the fourth edge, and first, second, third, and fourth column portions extending from first, second, third, and fourth corners of the upper blank central region, said upper blank central region and said lower blank central region having substantially the same shape and are substantially equal in size;

wherein a lower surface of the upper blank is adhesively attached to an upper surface of the lower blank so as to line up the upper central region on top of the lower central region.

14. The knockdown assembly according to claim 13 wherein each column portion includes a median edge integral with the upper blank central region and a lateral edge, wherein each column portion is folded upon itself, and wherein the lateral edge is secured proximate to the median edge.

15. The knockdown assembly according to claim 13 wherein each column portion includes a plurality of fold lines dividing each of said column portions into at least three column walls, wherein one of said column walls of each of said column portions is adjacent to and in face to face relationship with one of said second and fourth sidewall segments of said lower blank.

16. The knockdown assembly according to claim 15 wherein said column walls are foldable relative to one another about said fold lines such that each of said column columns has a polygonal cross-section when said knockdown assembly is assembled into said display tray.

17. A knockdown assembly configured to be assembled into a display tray having first, second, third and fourth side panels and four corner columns, the knockdown assembly comprising:

a lower blank comprising a lower blank central region having first, second, third, and fourth edges and surrounded at each edge by first, second, third and fourth sidewall segments, at least the first and third sidewall segments including a rollover portion, wherein each of said second and fourth sidewall segments extend from a respective first end to a respective second end, and wherein end flaps are attached to each first end and each second end of both the second and fourth sidewall segments;

an upper blank comprising an upper blank central region having first, second, third, and fourth edges, a first sidewall segment attached at the second edge, a second sidewall segment attached at the fourth edge, and first, second, third, and fourth column portions extending from first, second, third, and fourth corners of the upper blank central region, lower sidewall segment fold lines separating said second and fourth sidewall segments of said lower blank from said lower blank central portion;

upper sidewall segment fold lines separating said first and second sidewall segments of said upper blank from said upper blank central portion;

said upper blank central region and said lower blank central region having substantially the same shape and size;

wherein a lower surface of the upper blank is adhesively attached to an upper surface of the lower blank so as to line up the upper central region on top of the lower central region; and wherein said lower sidewall segment fold lines and said upper sidewall segment fold lines are adjacent and parallel to one another so as to allow said second sidewall segment of said lower blank and said first sidewall segments of said upper blank, and said fourth sidewall segment of said lower blank and said second sidewall segment of said upper blank to fold together as a unit to form portions of said second and fourth side panels of said display tray when the knockdown assembly is assembled into the display tray.

* * * * *